US006913222B2

(12) United States Patent
Maxwell et al.

(10) Patent No.: US 6,913,222 B2
(45) Date of Patent: Jul. 5, 2005

(54) LIGHTWEIGHT COLLAPSIBLE REEL FOR CABLE, CONDUIT OR TUBING

(76) Inventors: Donald J. Maxwell, 2300 Folsom Ct., Lincoln, NE (US) 68522; David Vossen, 200 Bluff Dr., Somerset, WI (US) 54025

( * ) Notice: Subject to any disclaimer, the term of this patent is extended or adjusted under 35 U.S.C. 154(b) by 63 days.

(21) Appl. No.: 10/656,937

(22) Filed: Sep. 5, 2003

(65) Prior Publication Data

US 2005/0051664 A1 Mar. 10, 2005

(51) Int. Cl.[7] ..... B65H 75/24
(52) U.S. Cl. ..... 242/407.1; 242/607.1
(58) Field of Search ..... 242/607.1, 407.1, 242/118.4, 118.6

(56) References Cited

U.S. PATENT DOCUMENTS 2,909,340 A * 10/1959 Whitaker ..... 242/607.1
3,791,606 A 2/1974 Brown
5,649,677 A 7/1997 Culp ..... 242/307.1

* cited by examiner

*Primary Examiner*—John M. Jillions
(74) *Attorney, Agent, or Firm*—Hovey Williams LLP

(57) ABSTRACT

A lightweight, collapsible, readily repairable, minimum thickness reel for cable, conduit, tubing or the like and the components of which are preferably molded of synthetic resin material. The end flanges of the reel each have a flat inner surface and a cellular outer surface for decreased weight. Molded, foldable ribbed tubing support units are interposed between the inner surfaces of the end flanges for receiving and supporting cable, conduit or tubing wound therearound when the support units are extended. The planar, inner surfaces of the end flanges have recesses for complementally receiving the rib portions of the leg segments of respective support units so that when the reel is in its collapsed condition the reel is not substantially thicker than the combined thickness of the side by side end flanges. The end flanges are molded of a synthetic resin material in a mold which receives pre-molded leg segments with a release agent thereon which results in concomitant forming of the recesses for the folding leg segments of the support units. A blowing agent may be incorporated in the resin in which the flanges are molded so that a relatively thin, tough, abrasion resistant skin is formed while the interior of the wall structure of the flange is of decreased density.

23 Claims, 4 Drawing Sheets

LIGHTWEIGHT COLLAPSIBLE REEL FOR CABLE, CONDUIT OR TUBING

BACKGROUND OF THE INVENTION

1. Field of the Invention

This invention relates to a lightweight, collapsible reel for supporting cable, conduit or tubing wound therearound and especially to a reel collapsible to a thickness no greater than approximately the thickness of the two side by side circular end flanges of the reel. The components of the reel are especially adapted for fabrication of synthetic resin material which results in an extremely lightweight reel that retains its load bearing properties and characteristics after repeated in-field use of individual reels.

Collapsible reels for supporting products such as elongated stretches of a cable, conduit or tubing wound around the core of the reel are known but have not heretofore gained widespread recognition in the field. Although deficiencies in marketing of past collapsible reels may have been a contributing factor in limited customer demand for prior reels, the inability of such reels to fully collapse and the excessive weight of the reels even when collapsed no doubt has been a limiting deterrent to widespread adoption and use.

2. Description of the Prior Art

Brown, in U.S. Pat. No. 3,791,606, illustrates a cable spool said to be collapsible but as illustrated in FIG. 4 of the patent drawings, folding of the central bar or leg segments 13 results in collapse of the reel such that there is still a space between opposing flanges 5 that substantially exceeds twice the width of one of the flanges 5. Thus, Brown in the '606 patent does not disclose or suggest a collapsible lay flat reel. Brown teaches the provision of a spool in which the end flanges are movable toward one another but opposed margins of the foldable leg segments form a V when folded which limits collapse of the reel flanges.

Similarly, in Culp U.S. Pat. No. 5,649,677, the patentee provides a collapsible spool having a plurality of foldable arms 16 which fold into a state of maximum collapse, as illustrated in FIG. 8. The overall thickness of the reel when collapsed is substantially greater than twice the thickness of one of the end flanges.

SUMMARY OF THE INVENTION

The present invention provides a lightweight, collapsible reel for cable, conduit or tubing in which a pair of opposed, relatively thin, generally circular, coaxially end flanges of substantially equal diameter are interconnected by at least three foldable cable, conduit or tubing support units. The reel, when fully collapsed, is no thicker than twice the thickness of each individual end flange. The support units, which each include a pair of hingedly interconnected end-to-end leg segments that cooperate in their fully extended, straight-line positions, to present a generally triangular cage internal of the space between the flanges for wrapping of cable, conduit, tubing or the like around the support units.

The end flanges and support units are designed and especially adapted to be individually molded as one-piece from synthetic resin material. Preferably, the flanges in the leg segments of the support units are molded of a synthetic resin material in prefabricated molds utilizing a resin such as polypropylene containing a conventional blowing agent so that a thin, relatively tough, abrasion resistant outer skin is formed from compaction of the resin at the surface of the part while the lower density resin produced by the blowing agent serves as an internal support for the skin.

In order to minimize the overall weight of the reel without sacrifice of its utility and strength characteristics, each of the unitary flanges has an inner relatively flat face, and an outer cellular face defining a plurality of weight saving spaces. In a preferred embodiment, the outer portion of each of the flanges includes an outer annular band of end-to-end rectangular pockets, an intermediate annular section of web defining trapezoidal spaces, and an innermost central section of generally polygonal areas.

The leg segments of the support units are preferably molded to define a series of elongated, side by side ribs which increase the beam strength of the individual segments while saving weight. The flanges are provided with a series of elongated recesses located to complementally receive the rib portions of respective leg segments of the support units. When the reel is collapsed by folding of the support units, the rib portions of the leg segments of each support unit, which face outwardly relatively, are fully received in respective recesses in the flanges so that the inner faces of the flanges move into interengaging, side by side relationship. The result is a reel when collapsed that is no thicker than the thickness of the side by side flanges.

The leg segments of respective support units are pivotally interconnected by a pin. Individual leg segments, which are all of identical construction, are all molded separately. Each of the ribbed leg segments has openings at opposite ends thereof. Pivot pins are inserted in the openings in one end of three leg segments. The three leg segments with the inserted pins, are then placed in a mold for a respective end flange with the pivot pins located 120° apart in spaced relationship as required for formation of the triangular cable, conduit or tubing cage to be defined by the support units. The leg segments with the inserted pins are located in the mold such that the ribbed surfaces face inwardly of the mold cavity. The mold also incorporates cavity defining surfaces for the cellular outer face of each of the molded flanges. By molding the individual leg segments along with the flange itself, the ribs of the leg segments form indentations or recesses in the inner surfaces of the flange so that the leg segments which are pivotally connected to the flange are inherently complementally received in the formed recesses. It is to be understood in this respect that a mold release agent is applied to the ribbed surfaces of the leg segments that are pivotally joined to a respective flange so that upon removal of the molded part from the mold, the leg segments that have been molded in place may readily be pivoted to their open, outwardly extended positions.

Upon completion of two molded flanges with incorporated leg segments, the leg segments of both flanges are extended outwardly and pivot pins inserted within aligned holes in what becomes end-to-end leg segments of respective support units.

The end flanges are provided with central openings which are coaxial in the completed reel so that a guide rod or pipe may be inserted through the aligned openings to guide or support the reel as a cable, conduit or tubing is unwound from the expanded reel.

An important advantage of the present collapsible reel is the fact that manufacture of the reel of synthetic resin material as explained permits recycling of the reel at the end of its useful life, which in most instances should be at least the order of fifty cycles of use. Another advantage is the minimal thickness of a fully collapsed reel, which is ⅙th to ⅐th that of a conventional reel. The no more than 2× flange thickness of each collapsed reel results in significant savings in return transportation costs of empty reels in collapsed condition from a space standpoint, in that a significantly larger number of reels may be transported in the space that would have been taken up in the transport vehicle by conventional reels. In addition, minimization of warehousing space required for empty reels provides significant cost savings. The collapsed reels are much easier to handle and maneuver because of the decreased weight as compared with conventional plywood reels.

DESCRIPTION OF THE PREFERRED EMBODIMENT

Figure 2:
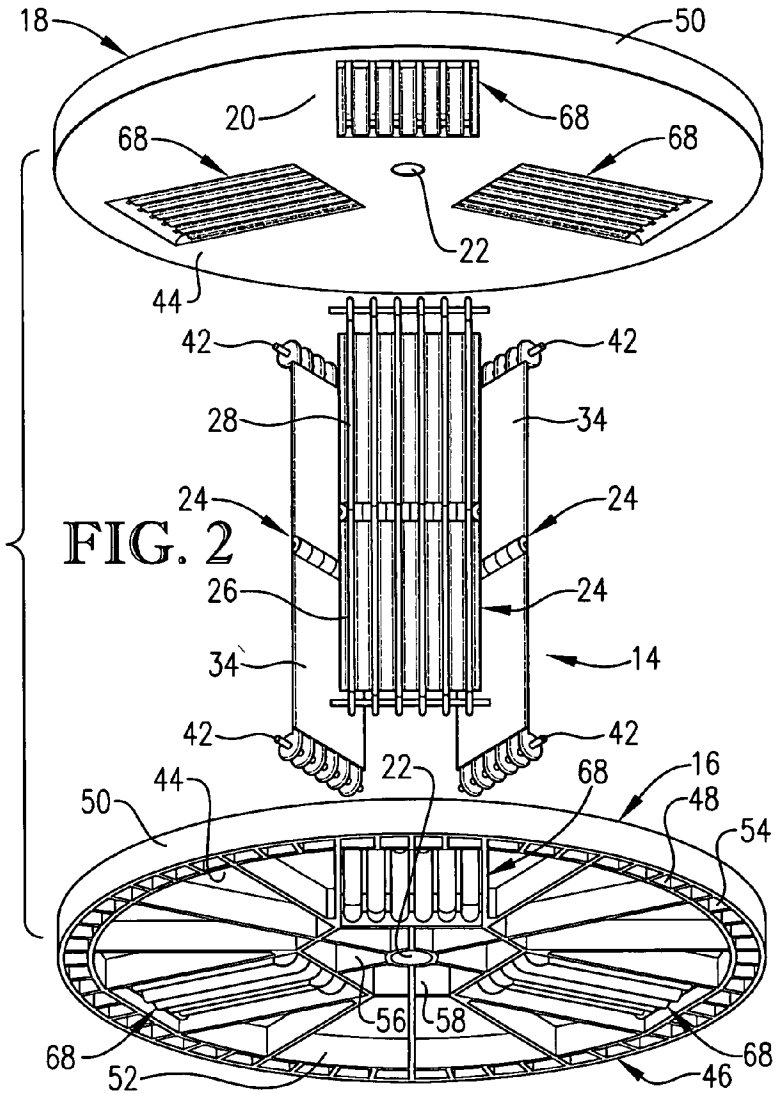
FIG. 2 is an expanded isometric view of the collapsible reel.
Figure 1:
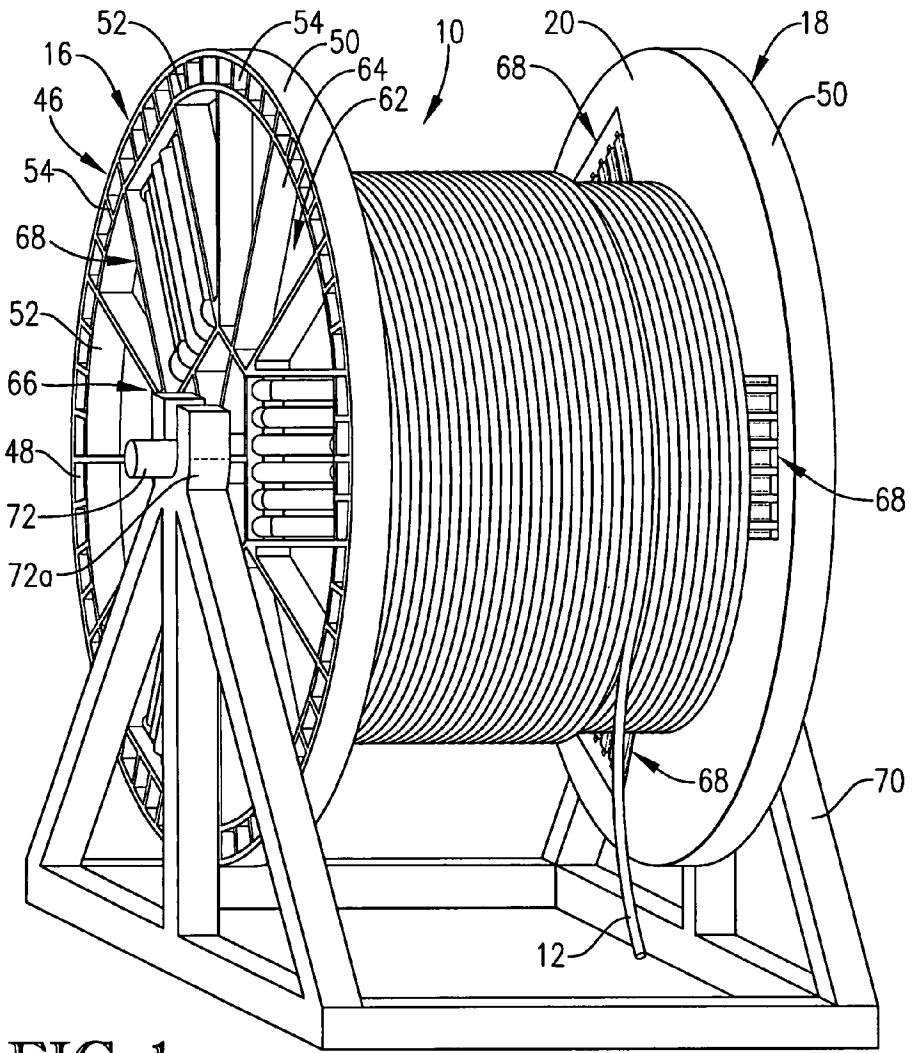
FIG. 1 is an isometric view of a collapsible reel constructed in accordance with the preferred concepts of this invention and showing the reel with cable, conduit or tubing wound therearound and supported by a conventional reel stand.
Figure 7:
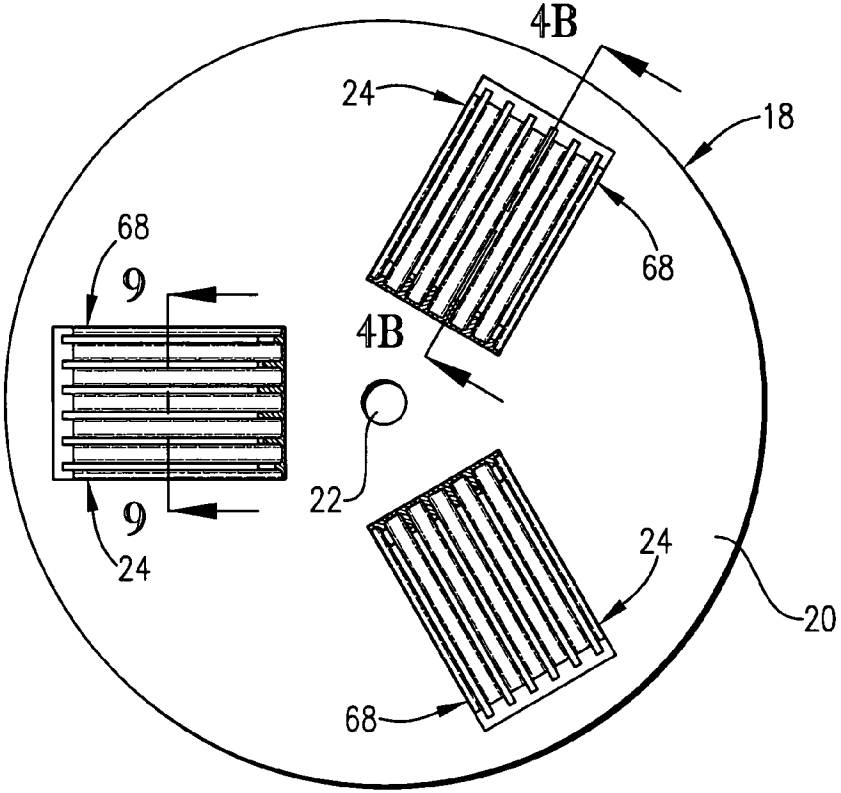
FIG. 7 is an end elevational view of one of the end flanges as molded with the cable, conduit or tubing support units molded in the positions thereof recessed in face.

The collapsible reel, broadly designated by the numeral 10 in the drawings, is especially adapted in its expanded condition, as shown in FIG. 1 of the drawings to support cable, conduit or tubing 12 or the like wrapped around the central cage defining structure, designated by the numeral 14 in FIG. 2. Reel 10 includes two opposed, relatively thin, identical, generally circular, oppositely oriented, coaxially positioned end flanges 16 and 18.

For simplicity, in view of the identical nature of flanges 16 and 18, the same component parts of each of the flanges 16 and 18 are given the same number in the drawings. Thus, as is apparent from FIGS. 1 and 2, each of the circular end flanges 16 and 18 has an inner, relatively flat face 20 provided with a circular guide rod or pipe opening 22 in the center thereof.

Figures 8, 9, 10:
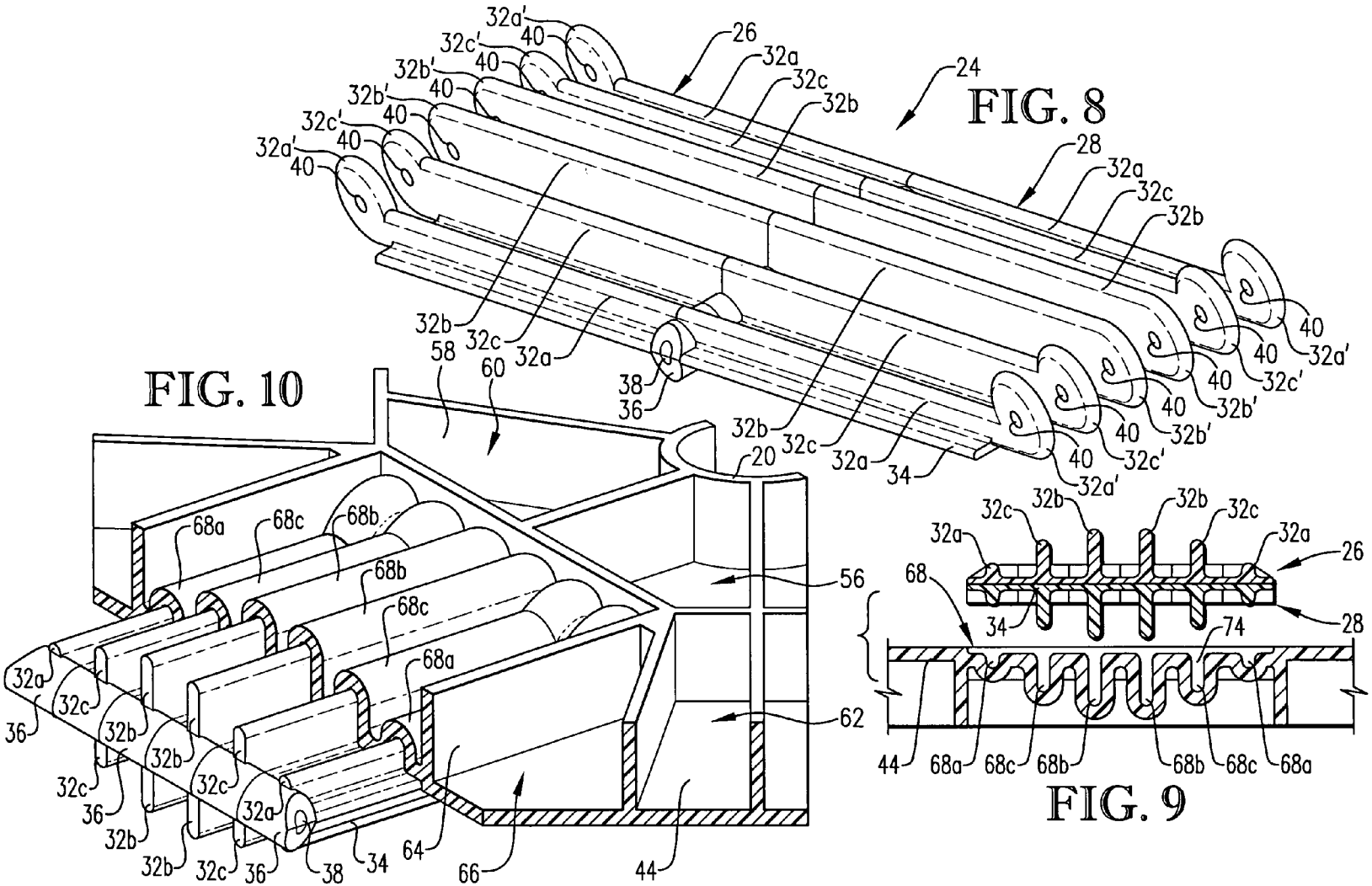
FIG. 8 is an isometric view of one of the three tubing support units that pivotally interconnect the end flanges of the reel.
FIG. 9 is an expanded fragmentary cross-sectional view of one of the leg segments of a support unit and taken on the line 9—9 of FIG. 7.
FIG. 10 is an enlarged fragmentary isometric view of a portion of one of the end flanges and showing one of the leg segments of a support unit telescoped in recesses for the leg segments in the flange.

Three foldable cable, conduit or tubing support units 24 are hingedly connected to opposed inner faces 20 of end flanges 16 and 18. Each support unit 24 includes a pair of identical leg segments 26 and 28 which are joined end-to-end by respective pivot pins 30 as best shown in FIG. 8. The leg segments 26 and 28 are of identical construction and are preferably molded in one-piece as detailed hereunder. Each leg segment 26 and 28 has a plurality of elongated, transversely spaced ribs 32 which are integral with a planar body portion 34, as is to be noted from the cross-sectional view of FIG. 9. As is evident from that view, the two outer most rib portions 32*a* are of lesser height, the two innermost rib portions 32*b* are of greatest height and the rib portions 32*c* between respective outer most rib portions 32*a* and innermost rib portions 32*b* are of intermediate height. Ribs 32*a*, 32*b* and 32*c* are of heights selected so that in the extended condition of reel 10 with the leg segments 26 and 28 or each of the support units 24 being in linear, aligned relationship, as shown for example, in FIGS. 3 and 4A, the outer margins of ribs 32*a*, 32*b* and 32*c* collectively, essentially define an imaginary cylinder. For example, in the case of an illustrative reel 10, having a diameter of 30", the outer margins of ribs 32*a*, 32*b* and 32*c* of support units 24 may for example lie in imaginary cylinder having a radius of about 5".

Figure 4B:
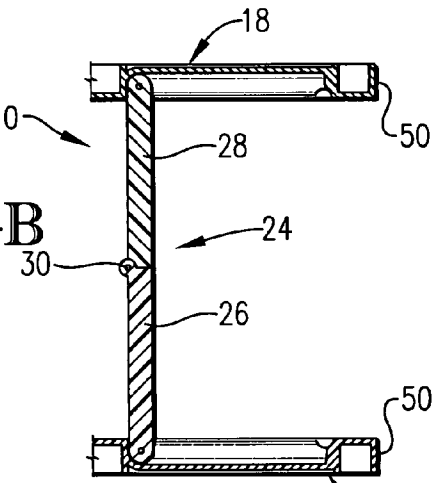
FIG. 4B is a fragmentary, cross-sectional view through the expanded collapsible reel of FIG. 4A and taken on line 4B—4B of FIG. 7 through one of the three circumferentially spaced, foldable cable, conduit or tubing support units pivotally interconnecting the circular end flanges of the reel.
Figure 5B:
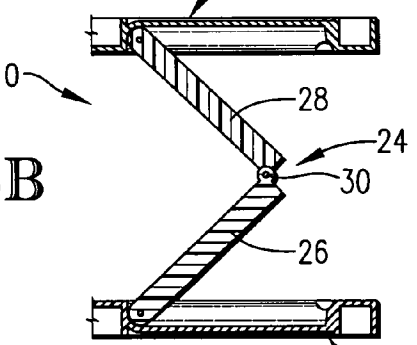
FIG. 5B is a fragmentary, cross-sectional view taken on the same line as FIG. 4B and illustrating the support unit as depicted in FIG. 4B in its partially collapsed condition.
Figure 4A:
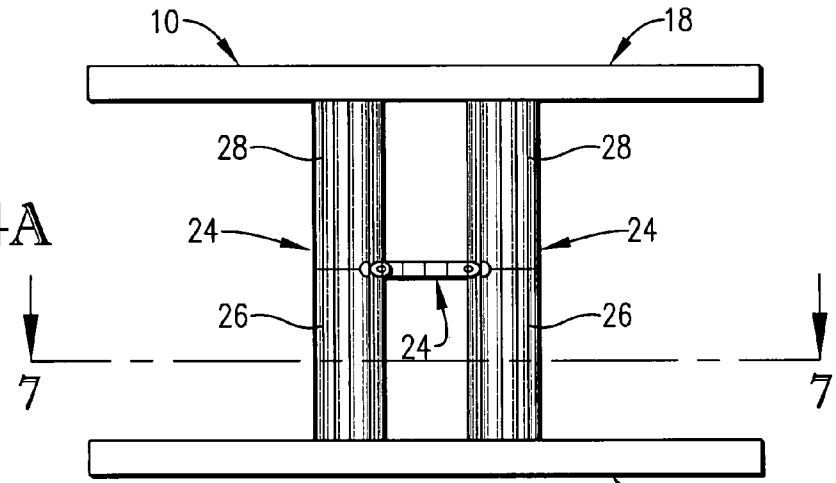
FIG. 4A is a generally schematic elevational view on a reduced scale of the collapsible reel in its expanded condition.
Figure 5A:
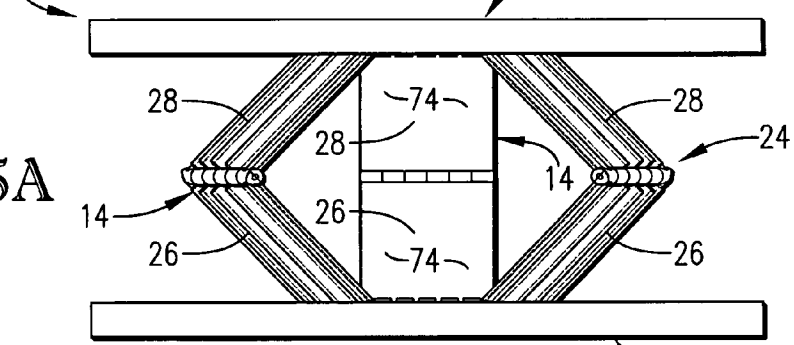
FIG. 5A is a generally schematic elevational view on a reduced scale of the collapsible reel in a partially collapsed condition.

The ends of leg segments 26 and 28 which are an end-to-end relationship as shown in FIG. 8, have interlocking cylindrical portions 36 provided with cross openings 38 therein for receipt of pivot pins 30. It is to be further observed that the leg segments 26 and 28 of each support unit 24 are moveable from the straight-line disposition as shown in FIGS. 4A–4B to the filly folded positions shown in FIGS. 6A and 6B as the leg segments 26 and 28 pivot about pins 30. Cooperable detents (not shown) may be provided on the ends of leg segments 26 and 28 which interengage in the extended linearly aligned disposition of leg segments 26 and 28 of support units 24 for retaining leg segments 26 and 28 filly extended until it is desired to fold support units 24 to collapse reel 10.

The extremity of each of the ribs 32*b* of leg segments 26 and 28 remote from cylindrical portions 36 has a circular end surface 32*b*' while the extremities of ribs 32*a* and 32*c* of each leg segment 26 and 28 have integral, semi-circular end caps 32*a*' and 32*c*'. The end caps 32*a*' and 32*c*', and the ends of ribs 32*b* terminating in circular surfaces 32*b*' of each of the leg segments 26 and 28 are provided with a series of aligned coaxial pivot pin receiving openings 40. The cross-openings 40 through end caps 32*a*' and 32*c*', and the end surfaces 32*b*' of leg segments 26 and 28 respectively have aligned, coaxial pivot pin receiving openings 40. The aligned openings 40 at the outer ends of each of leg segments 26 and 28 receive elongated pivot pins 42, each of which projects outwardly beyond the outer surfaces of end caps 32*a*', as shown in FIG. 2.

Inner faces 20 of end flanges 16 and 18 are defined by relatively thin, planar panel portion 44 (FIGS. 9 and 10) which nominally may be approximately ¼" thick. In addition, all component portions of the flanges 16 and 18 are of the preferred ¼" thickness. The ribs 32*a*, 32*b* and 32*c* are all approximately ¼" thick while planar bottom portion 34 of each of the leg segments 26 and 28 is preferably ⅛" thick. The diameter of reel 10 as presented by flanges 16 and 18 may be varied, with one preferred dimension being about 30". Each of the flanges 16 and 18 may, for example, be about 1½" in depth front to back.

The wall structure of end flanges 16 and 18 includes outwardly facing cell defining component portions which project in opposite directions from respective panel portions 44, include an outer, annular cellular band 46 made up of a plurality of end-to-end generally rectangular open pockets 48 defined by the outer annular rim portion 50, and inner rim portion 52 and a series of circumferentially spaced, radially extending wall portions 54. The pockets 48 are approximately 1¼" deep.

Figure 3:
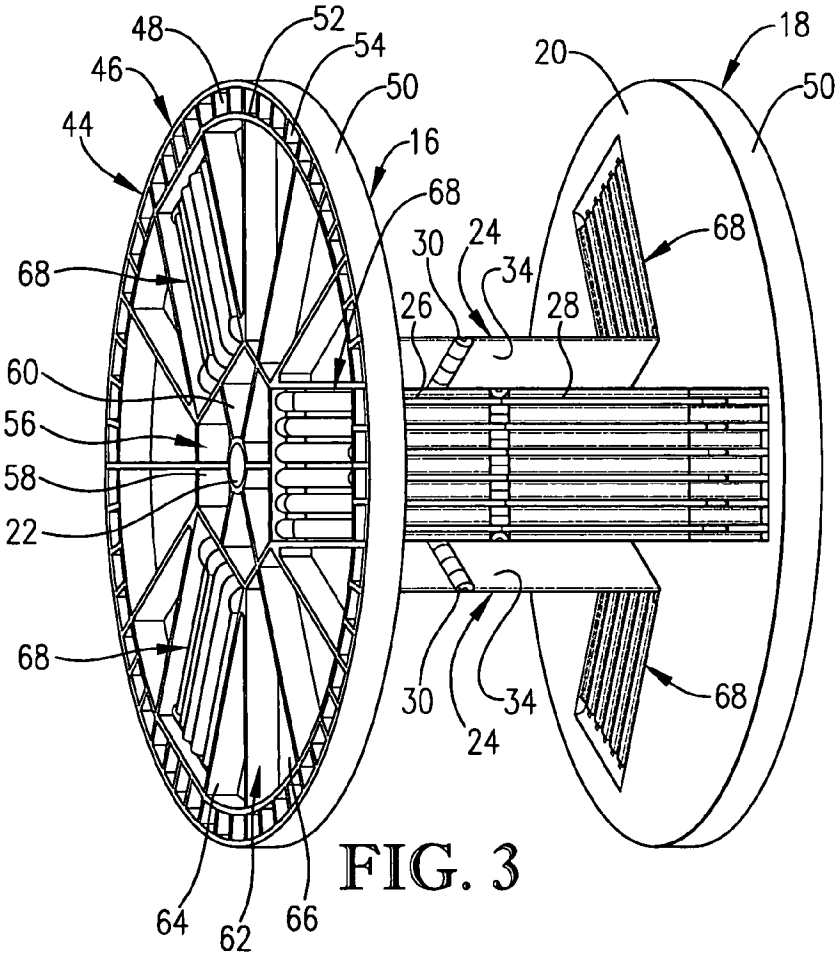
FIG. 3 is an isometric view of the collapsible reel minus the cable, conduit or tubing shown in FIG. 1 and illustrated without support of a reel stand.

A central outboard cellular section 56 of the flanges 16 and 18, best shown in FIGS. 2 and 3, surrounds a respective opening 22 in coaxially relationship thereto and has a plurality of individual web segments 58 that make up a number of circumferentially extending open polygonal areas 60. Here again, each of the areas 60 is approximately 1¼" deep.

An intermediate outboard cellular section 62 in each of the flanges 16 and 18 surrounds central cellular section 56 and has a series of generally radial, spaced webs 64 that cooperate with the inner rim portion 52 and web segments 58 to define a plurality of circumferentially extending open trapezoidal areas 66. The areas 66 are also approximately 1¼" deep.

In those instances where three foldable support units 24 are provided between and pivotally connected to flanges 16 and 18, three radially extending and circumferentially spaced cavity areas 68 are provided in the wall structure panel portion 44 of each of the flanges 16 and 18. The cavity areas 68 have a series of elongated, parallel, transversely spaced recesses for the respective ribs 32*a*, 32*b* and 32*c* of leg segments 26 and 28 of supports units 24 when the support units 24 are in their fully collapsed condition. As is most evident from FIGS. 9 and 10, each of the cavity areas 68 includes two elongated, outboard, unitary, transversely spaced, U-shaped recesses 68*a* configured to complementally receive respective outboard ribs 32*a* of a corresponding leg segment 26 and 28. Similarly, two elongated, inboard, unitary, transversely spaced, U-shaped recesses 68*b* are provided which complementally receive respective ribs 32*b* of corresponding leg segments 26 and 28 of support units 24. Two elongated, intermediate, unitary, transversely spaced, U-shaped recesses 68*c* complementally receive the ribs 32*c* of leg segments 26 and 28 of support units 24.

When the support units 24 are unfolded to provide an extended reel as shown in FIG. 3, the reel 10 is adapted to receive a cable, conduit or tubing 12 as shown in FIG. 1. The imaginary cylinder defined by the outer margins of ribs 32 of the three support units 24 serves as a support for cable, conduit or tubing 12 which may be wound therearound in a pattern as shown in FIG. 1. The reel 10 with the cable, conduit or tubing 12 thereon may be shipped as a unit and a plurality of the reels stacked one on top of the other with the outer faces of the reels interengaging as is conventional with standard wooden reels. At the site of use, the reel 10 may be positioned on a support such as stand 70 as depicted in FIG. 1, in which a rod or pipe 72 passing through a line openings 22 in flanges 16 and 18 is typically received within a U-shaped open top saddle 72*a* forming a part of stand 70. The cable, conduit or tubing 12 may be pulled from reel 10 as it rotates about the axis of rod or pipe 72. Alternatively, reel 10 may be supported for rotation upon the body of a mobile vehicle such as a truck.

Figure 6B:
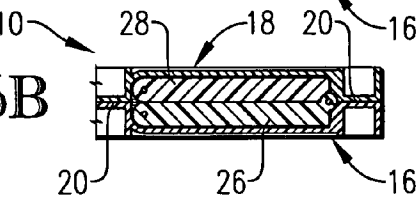
FIG. 6B is a fragmentary, cross-sectional view through the reel in it filly collapsed condition.
Figure 6A:
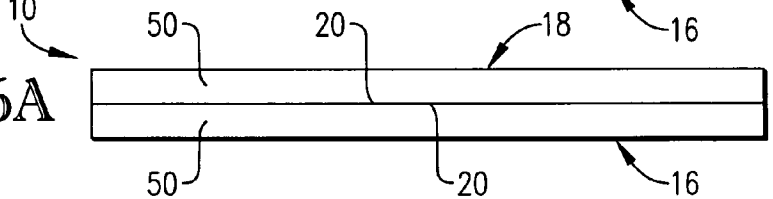
FIG. 6A is a generally schematic elevational view on a reduced scale of the reel in its fully collapsed condition with the circular flanges of the reel in side by side, substantially interengaging relationship.

Upon depletion of the supply of cable, conduit or tubing 12 carried by reel 10, the reel 10 may be collapsed to the condition illustrated in FIG. 6A for shipment. The support units 24 may be folded about the axes of respective pivot pins 30 whereby ribs 32*a*, 32*b* and 32*c* are received in corresponding recesses 68*a*, 68*b* and 68*c*. It can be observed from FIG. 9 that the panel portion 44 of each of the flanges 16 and 18 has three radially extending, circumferentially spaced, rectangular indentations 74 in the faces 20 of panel portions 44 which are configured to complementally receive the planar bottom portion 34 of a respective leg segment 26 and 28 of support units 24. As a consequence, when support units 24 are folded into their fully collapsed positions, the faces 20 of flanges 16 and 18 are in flat, fully conforming interengagement with essentially no space there between as shown schematically in FIGS. 6A and 6B.

It is also to be seen from FIGS. 8 and 10 that when the leg segments 26 and 28 of the support units 24 are brought into linear, aligned relationship as best shown in FIG. 8, the extremities 32*a*", 32*c*"and 32*b*" of leg segments 26 and 28 move into abutting relationship while adjacent ends of the flat surfaces of respective planar bottom portions 34 complementally interengage, thereby preventing the leg segments 26 and 28 from swinging overcenter during pivoting about pivot pins 30. The interengagable detents on adjacent ends of fully opened leg segments 26 and 28 cooperate to maintain the leg segments 26 and 28 in end-to-end aligned relationship.

A preferred procedure for manufacture of reel 10 involves pre-molding of a supply of leg segments 26 and 28, which it is to be observed are of identical construction and configuration. The leg segments 26 and 28 may be molded of a suitable synthetic resin such as polypropylene whereby the leg segments 26 and 28 are solid throughout the thickness of the individual leg segments 26 and 28, or in the alternative, leg segments 26 and 28 may be fabricated of a synthetic resin composition in which a resin such as polyproplyene contains an amount of a blowing agent that is compatible with the resin. If formed, for example, from polypropylene which includes a quantity of a blowing agent, during molding of the parts, gases generated by the blowing agent cause the outer surface of the part to become denser than the interior portions of the part, thereby defining a tough, homogeneous, substantially void-free outer skin layer. The thickness of the skin layer will nominally be of the order of 0.060" to about 0.100". The overall thickness of the wall structures of flanges 16 and 18 will nominally be about ¼".

The outer rim portion 50 of each of the end flanges 16 and 18 which define the overall thickness of respective flanges 16 and 18 nominally or about 1½". The leg segments 26 and 28 generally are about 1⅛" thick overall. A fully collapsed reel 10, as shown in FIGS. 6A and 6B, has a maximum folded thickness of only about 3".

The faces of the three leg segments 26 or 28 of support units 24 which face outwardly to define cage 14 when reel 10 is unfolded, are sprayed with a mold release agent. The treated leg segments 26 or 28 with pins 42 in place in openings 40 are strategically placed in the mold for end flanges 16 or 18 with the outer surface of planar bottom portions 34 of leg segments 26 and 28 lying in a plane that is planar with the face 20 of the end flanges 16 or 18 to be molded.

Next, a synthetic resin, such as polypropylene which contains a blowing agent, is introduced into the mold for a respective end flange 16 or 18. The polypropylene/blowing agent composition is then allowed to expand into the cavity of the mold defining an end flange 16 or 18. As previously explained, expansion of the polypropylene by the blowing agent incorporated into the resin formulation causes a relatively tough, homogeneous, substantially void-free outer skin layer to be formed throughout the extent of the end flange 16 or 18, which fully encloses the cellular synthetic resin interior of the part. It is believed that the density of the resin making up the interior of the formed flange decreases in a direction away from the outer skin toward the center of the part.

By forming each of the flanges 16 and 18 with the support units 24 in their normal folded positions thereof, support units 24 may readily be swung outwardly from the finished part because of the release agent that was applied to the surfaces of the leg segments 26 and 28 which face inwardly of the mold during the fabrication of a respective flange 16 or 18. It is important to note in this respect that by molding of the leg segments 26 and 28 in place during forming of the end flanges 16 and 18, the pivot pins 42 are also correctly molded in position. It would be difficult and more expensive to locate the pivot pins 42 in flanges 16 and 18 after molding of the flanges than is the case with molding of the pivot pins in place in flanges 16 or 18.

In addition, molding of the end flanges 16 and 18 with a leg segment 26 and 28 positioned in the flange mold results in the outer surfaces of ribs 32 accurately forming complemental recesses for ribs 32 of each leg segment 26 and 28 when the support units 24 are folded to collapse the reel 10 and thereby bring the faces 20 of end flanges 16 and 18 into proximal interengaging relationship.

The synthetic resin used for molding of leg segments 26 and 28 of support units 24 should be of characteristics and properties such that the formed leg segment part is capable of withstanding and not be deformed by the elevated temperature environment within the interior of the mold(s) used to fabricate end flanges 16 and 18.

Although polypropylene is the preferred resin for fabrication of reel 10, other resins may be employed such as high-density polyethylene. Suitable blowing agents for the resin include thermally decomposable foaming agents such as sodium bicarbonate, azodicarbonamide and the like, an inert gas such carbon dioxide, nitrogen and the like, or an organic compound having a low boiling point such as butane and the like. Additives may also be incorporated in the resin to enhance the physical characteristics of the formed reel, such as glass fibers or the like, particularly in the skin layer of the formed components, and inorganic fillers such as talc, silica, and the like added as a nucleating agent for the forming foam cells. A conventional flexiblizer component may be added to the resin if desired.

Although the preferred reel 10 is constructed as illustrated and described having a cellular outer face in order to save weight and decrease the cost of the reel 10, it is to be understood that if desired the wall structure of end flanges 16 and 18 may be essentially of solid construction except for the recesses receiving the ribs 32 of leg segments 26 and 28. Similarly, support units 24 may be constructed as essentially flat components without the provision of ribs 32. In these instances, the end flanges 16 and 18, and support units 24 would desirably be molded of a synthetic resin having a blowing agent incorporated therein to produce end flanges and support units having a high strength to weight ratio.

When formed of the defined resin and constructed of the dimensions described, a 30" diameter reel having a fully opened width approximating that of the diameter of flanges 16 and 18 will hold at least about 400 pounds of cable, conduit or tubing wound therearound.

What is claimed is:

1. A lightweight collapsible reel for cable, conduit or tubing comprising:

a pair of opposed, relatively thin, generally circular, coaxial end flanges of substantially equal diameter and having wall structure defining a respective flange, each of said flanges having a center point and opposed, inner, essentially parallel surface portions;

at least three circumferentially spaced, foldable cable, conduit or tubing support units positioned between said inner surfaces of the flanges and hingedly interconnecting the flanges, each of the support units including a pair of elongated end-to-end leg segments, and a device pivotally interconnecting the adjacent extremities of each pair of leg segments, said adjacent extremities of each pair of end segments having interacting components limiting relative pivoting motion of the segments of each support unit from a folded position in which the segments are in folded overlying relationship to extended disposition in which the segments of a respective support unit are in an essentially straight line, said support units when extended supporting cable or tubing wrapped around all of the extended support units between the inner surface portions of the flanges;

pivot structure swingably attaching the outermost ends of the segments of each support unit to respective opposed inner surfaces of the flanges, said wall structure of the flanges having recesses for generally complementally receiving a respective segment of each of the support units pivotally connected to a corresponding flange in order that the overall thickness of the reel is not substantially greater than the side by side thickness of the two flanges when the reel is fully collapsed and the segments of the support units are moved from their extended positions to their folded positions with the leg segments thereby received in the recesses in respective flanges.

2. A collapsible reel as set forth in claim 1 wherein said flanges and the support units are each of synthetic resin material.

3. A collapsible reel as set forth in claim 1 wherein said flanges and the support units have wall structure configured to permit molding of each flange from a synthetic resin material.

4. A collapsible reel as set forth in claim 3 wherein each of said flanges and each of said leg segments of the support units are each configured to be molded in one-piece respectively.

5. A collapsible reel as set forth in claim 2 wherein the inner surface of each of the flanges is of generally flat configuration and the outer surface of respective flanges is of generally cellular configuration to decrease the weight of the reel while at the same time retaining the structural integrity of the flange.

6. A collapsible reel as set forth in claim 3 wherein the wall structure each of the molded flanges and each of the leg segments of the support units have a relatively tough, outer, abrasion resistant surface skin and a unitary interior of lower density than the outer surface skin.

7. A collapsible reel as set forth in claim 6 wherein said synthetic resin material inside of the skin contains a particulate solid additive for increasing the strength of the synthetic resin interior of the reel.

8. A collapsible reel as set forth in claim 6 wherein the interior of each of the molded flanges and each of the leg segments of the support units are of a synthetic resin material that decreases in density from the outer skin as the innermost part of a respective interior thereof is approached.

9. A collapsible reel as set forth in claim 7 wherein the synthetic resin interior portion material inside of the skin of each of the flanges is a synthetic resin material that contains a blowing agent that decreases the density of the interior portion of the flanges during molding thereof.

10. A collapsible reel as set forth in claim 3 wherein said synthetic resin material is a high density polythene resin.

11. A collapsible reel as set forth in claim 9 wherein the skin of each of the flanges and each of the leg segments of the support units are of polypropylene.

12. A collapsible reel as set forth in claim 4 wherein said pivot structure includes a pin molded in place in each of the flanges and pivotally supporting a respective leg segment of each of the support units adjacent the inner surface of a corresponding flange.

13. A collapsible reel as set forth in claim 4 wherein said device includes a pin molded in place in one of the end-to-end leg segments of a respective support unit and pivotally receiving the adjacent extremity of the other leg segment of the corresponding support unit.

14. A collapsible reel as set forth in claim 1 wherein said pivot structures attaching the outermost ends of the end segments of the support units are located in substantially equidistant, radially spaced relationship from the center point of respective end flanges.

15. A collapsible reel as set forth in claim 1 wherein each of the end-to-end leg segments of respective support units are provided with a plurality of reinforcement ribs extending longitudinally of each leg segment and spaced transversely of one another on each leg segment, said ribs being positioned to extend outwardly in opposite directions from one another when the support units are in the folded conditions thereof, said opposed surface portions of the flanges being provided with a series of said elongated recesses located to generally complementally receive the ribs of corresponding leg segments of each support unit when the support units are in their folded conditions.

16. A collapsible reel as set forth in claim 1 wherein the outer portions of each of the flanges opposite the inner surface portions thereof are provided with a plurality of spaces located to decrease the overall weight of each flange without significant sacrifice to the structural strength of the flange.

17. A collapsible reel as set forth in claim 15, wherein each of the flanges has an outer circumferentially extending cellular, annular band.

18. A collapsible reel as set forth in claim 1 wherein each of the flanges has an outer circumferentially extending cellular, annular band, a central cellular section, and an intermediate cellular section between the outer cellular band and the central cellular section.

19. A collapsible reel as set forth in claim 17 wherein said intermediate cellular section has a series of generally radial, spaced webs extending between the central section and the outer cellular band and presenting open generally trapezoidally shaped areas.

20. A collapsible reel as set forth in claim 17 wherein said cellular band has a plurality of end-to-end rectangular open pockets.

21. A collapsible reel as set forth in claim 17 wherein said central section has a series of web segments presenting open generally polygonal areas.

22. A collapsible reel as set forth in claim 1 wherein the distance between the next adjacent ends of the support units pivotally attached to respective inner surface portions of the flanges is less the width of respective support units.

23. A collapsible reel as set forth in claim 1 wherein the flanges are provided with coaxial center openings configured to receive a horizontal or upright support or guide rod or pipe for the reel having cable or tubing wound around the extended support units between the flanges.

* * * * *